United States Patent [19]

Owens

[11] Patent Number: 4,685,440

[45] Date of Patent: Aug. 11, 1987

[54] ROTARY DRESSING TOOL

[75] Inventor: Warren J. Owens, Columbia, S.C.

[73] Assignee: Wheel Trueing Tool Company, Columbia, S.C.

[21] Appl. No.: 832,350

[22] Filed: Feb. 24, 1986

[51] Int. Cl.[4] ..... B24B 53/14

[52] U.S. Cl. ..... 125/11 CD; 51/206 R

[58] Field of Search ..... 125/15, 39, 11 CD; 51/206 R

[56] References Cited

U.S. PATENT DOCUMENTS

| | | | |
|---|---|---|---|
| 1,507,836 | 9/1924 | King | 51/206 R |
| 1,941,283 | 12/1933 | Taylor | 76/108 |
| 2,073,590 | 3/1937 | Sanford | 51/278 |
| 3,157,174 | 11/1964 | Emery | 125/39 |
| 3,343,932 | 9/1967 | Juillerat | 51/293 |
| 3,440,774 | 4/1969 | Curn | 51/206 |
| 3,596,649 | 3/1971 | Olivieri | 125/11 |
| 3,791,367 | 2/1974 | Cirell et al. | 125/11 |
| 4,114,322 | 9/1978 | Greenspan | 51/206 R |
| 4,128,136 | 12/1978 | Generoux | 175/330 |
| 4,242,106 | 12/1980 | Morelock | 51/307 |
| 4,289,110 | 9/1981 | Junker | 125/11 |
| 4,373,933 | 2/1983 | Grazen | 51/309 |
| 4,411,250 | 10/1983 | Lach | 125/11 |
| 4,521,222 | 6/1985 | St. Pierre et al. | 51/295 |

FOREIGN PATENT DOCUMENTS

| | | | |
|---|---|---|---|
| 2844602 | 4/1980 | Fed. Rep. of Germany . | |
| 1242234 | 8/1971 | United Kingdom | 51/206 R |
| 536954 | 12/1976 | U.S.S.R. | 51/206 R |
| 608645 | 5/1978 | U.S.S.R. | 51/206 R |

OTHER PUBLICATIONS

Y. Yokota & K. Suzuki, "Rotary Diamond Dressing Triples Grinding Productivity", Feb. 86, Tooling & Production Magazine.

*Primary Examiner*—Harold D. Whitehead
*Attorney, Agent, or Firm*—Benoni O. Reynolds

[57] ABSTRACT

Apparatus and method to provide a rotary dressing tool, formed to the geometric shape of any part piece to be ground, which is utilized to reform an abrasive wheel so that it will produce desired dimensional characteristics on the part piece. A combination of diamond particles and preformed polycrystalline diamond segments are spaced around the outer perimeter of the tool and surrounded by a matrix of abrasive resistant nickel based alloy. Co-utilization of the diamond particles and the preformed segments creates a rotary dressing tool which is highly resistant to abrasive wear, enhancing the performance and durability of the tool.

6 Claims, 5 Drawing Figures

FIG. 3.
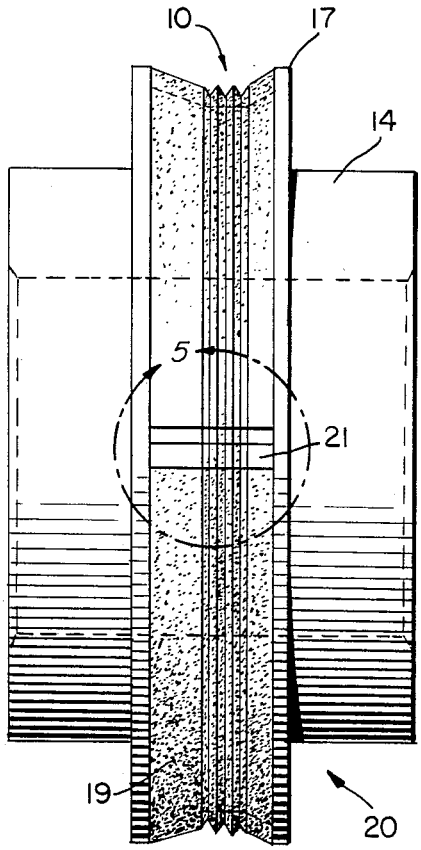
FIG. 4.
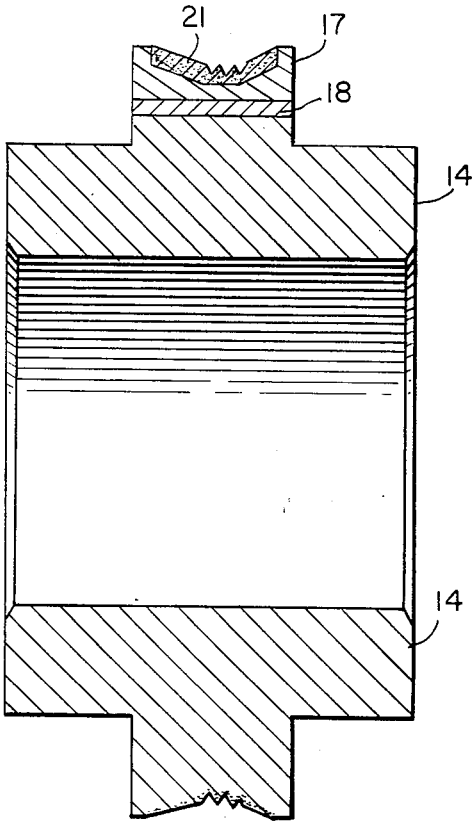
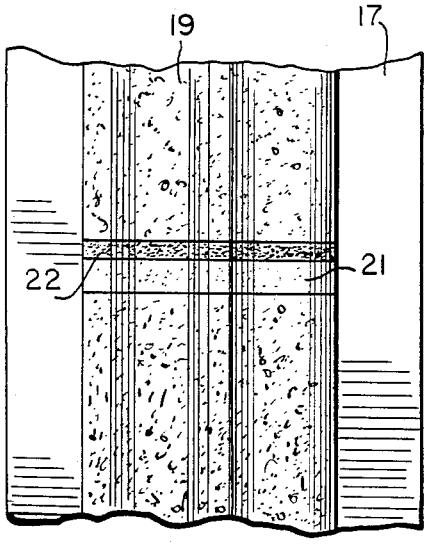
FIG. 5.

ROTARY DRESSING TOOL

BACKGROUND OF THE INVENTION

1. Field of Invention:

This invention relates generally to tools used to manufacture precision steel parts by a grinding process. In particular, it relates to tools for reforming and reconditioning an abrasive wheel which in turn imparts dimensional characteristics to a part piece of steel or of other hard material being precision ground by the abrasive wheel 2. Description of the Prior Art A rotary dressing tool is a cylindrical wheel whose periphery across the axial plane is profiled such that upon rotational contact with an abrasive wheel, the perimeter surface of the abrasive wheel will conform to the shape of the rotary dressing tool. The shape of the rotary dressing tool is manufactured to the geometric specification standard of a given part piece desired by a customer. After contact with the rotary dressing tool, the abrasive wheel is conditioned for utilization as a machining medium for production in quantity of the desired part piece.

Surprisingly, natural diamonds are not efficient in directly cutting profiles in part piece of steel. However, diamonds can be used effectively to impart intricate profiles to an abrasive (grit) wheel which in turn is very efficient in cutting a desired profile in the steel part piece. Conventional diamond dressing tools normally afford between 12,000 and 70,000 dresses before requiring return to the tool manufacturer for reconditioning the tool. The present invention utilizes not only randomly dispersed natural or synthetic diamond particles but preformed polycrystalline diamond segments as well. The segments are symmetrically or randomly placed about the periphery of the rotary dressing tool, in addition to the dispersed diamond particles, to enhance the operational life of the tool. Tests of the present invention have revealed a three-fold increase of dressing capacity, producing as many as 207,000 dresses before reconditioning was required.

Historically, two methods have been used to manufacture rotary dressing tools: (a) powdered metal sintered to hardness as a tool and (b) electroforming. Powered metal tools, although offering high resistance to abrasive actions of a grinding wheel, have serious limitations. Using such tools you cannot produce radii smaller than 0.005 inches. Thus, you cannot produce the intricate forms often required by the specifications of the customer. Also the use of the powdered metal tools depends upon the availability of suitable diamond reenforcements. You must use natural diamond reenforcements due to the sintering temperatures to which these tools are subjected during their manufacturing process.

On the other hand, rotary dressing tools manufactured by the electroforming process, where the diamond particles are electrically deposited on a nickel alloy trueing wheel, can be produced with extremely fine radii and very intricate geometries. However, smaller diamond particles must be used and the nickel alloy matrix holding the diamonds is less abrasive resistant to the abrasive wheel than the sintered powdered metal dressing tool. The latter considerations, of course, shorten the operational life of the dressing tool. Also, it is difficult to use natural diamond reenforcements because the irregular shape of natural diamond reenforcements does not facilitate the proper placement of the diamonds required for intricate cutting patterns.

The present invention addresses the problems of the prior art and combines the advantages of electroformed dressing tools with the enhanced abrasive resistance offered by the use of polycrystalline synthetic diamond segments. Also, the use of the segments permits the tool to be pre-profiled by a traveling wire e.d.m. (electrical discharge machine) to accommodate the most demanding and intricate grinding patterns.

BRIEF SUMMARY OF THE INVENTION

The present invention is a rotary dressing tool to reform and recondition an abrasive wheel used in imparting dimensional characteristics to part pieces of steel or other hard material.

Natural or synthetic diamond particles are dispersed about the periphery of the tool and embedded in a matrix of abrasive resistant nickel based alloy to provide a basic cutting surface for dressing an abrasive wheel. The matrix is bonded to a cylindrical metal core, preferably of stainless steel, by a filler of molten solder or plastic material. The cylindrical metal core has a bore hole and serves as a framework for the tool and permits the tool to be readily mounted to the driving spindle of a dressing assembly. In addition, three or more profiled segments of sintered superhard material are interspersed in the natural or synthetic diamond particles and matrix as an integral part thereof and spaced about the outer periphery of the tool to provide an enhanced cutting surface for dressing the abrasive wheel. Although the segments could be randomly spaced about the outer periphery of the tool, the profiled segments are symmetrically spaced about the outer periphery of the tool in its preferred embodiment. This spacing provides a uniform application of the enhanced resistance to abrasion offered by the superhard segments. Ideally, these segments are polycrystalline synthetic diamonds which have been pre-profiled to the dimensional requirements of the part piece to be ground by the abrasive wheel. Under the method of this invention, the segments are pre-profiled to the specifications of the customer by a traveling wire e.d.m. which permits intricate negative profiles to be cut in the segments with very fine radii otherwise not achievable.

The preferred method of constructing the rotary dressing tool of the present invention comprises the following steps:

forming three or more polycrystalline synthetic diamond segments by pre-profiling the cutting surface of the segments to the dimensional requirements of the part piece to be ground, using a traveling wire e.d.m., and forming a molding ring of aluminum or high grade graphite, whose inside perimeter has been machined on a lathe to the negative profile of the part piece to be ground by the abrasive wheel, and radially placing three or more polycrystalline segments symmetrically about the inner perimeter of the molding ring, in the formed area machined therein, holding the profiled segments in place temporarily with an electrically conductive adhesive or a five minute epoxy, and placing natural or synthetic diamond particles in the molding ring, with an anode nickel cup in the center, and by means of a centrifuge randomly dispersing the diamond particles about the inside periphery of the molding ring where the diamond particles become attached by an electrically deposited binder, and placing the molding ring in a conventional nickel plating tank where the molding ring remains for an extended period of time, usually about 16 days, under low direct current, preferably two amperes, to build a matrix of abrasive resistant nickel based alloy approximately 0.200 inches in thickness, forming a permanent bond in and about the dispersed diamond particles and the profiled segments, and placing a cylindrical metal core, preferably of stainless steel, in the center of the molding ring and mechanically bonding the cylindrical metal core to the matrix by injecting a filler of molten solder or plastic material into the space between the inside perimeter of the molding ring and the outer circumference of the cylindrical metal core, and surface grinding the tool to true up the sides of the tool so that the sides are perfectly parallel with respect to each other, and machining the cylindrical metal core to create a bore hole which is concentric and square with respect to the diamond cutting surface of the Rotary Dressing Tool, and removing the molding ring from the exterior perimeter of the Rotary Dressing Tool by turning the molding ring in a lathe, and running the circumferential surface of the Rotary Dressing Tool into a grinding wheel to expose the diamond particles and the polycrystalline synthetic diamond segments down to their working surfaces.

OBJECTIVES OF THE INVENTION

The objectives of the present invention are to provide a rotary dressing tool which:

(1) is simple and easy to construct;

(2) is unitary in design;

(3) utilizes a combination of natural or synthetic diamond particles and polycrystalline diamond segments as cutting media to reform or recondition an abrasive wheel;

(4) can be readily formed to the geometric shape of the part piece to be ground by the abrasive wheel;

(5) can impart intricate patterns of small radii to the abrasive wheel;

(6) is highly resistant to abrasive wear when forming patterns of small radii;

(7) as compared to a conventional dressing tool, will perform a substantially greater number of dressings prior to the need for reconditioning of the tool.

Other objectives and advantages of the present invention will be apparent in the course of the following detailed description, appended claims and accompanying drawings.

BRIEF DESCRIPTION OF THE DRAWINGS

FIG. 3 is a front view of the present invention (which is the same as the back view) showing how the outer periphery of the tool is formed to the geometric shape of the part piece to be ground by the abrasive wheel.

FIG. 4 is a vertical cross-sectional view of the present invention, taken substantially along line 4—4 of FIG. 2, showing how the polycrystalline diamond segment is embedded in a nickel based alloy which in turn is bonded to the cylindrrical metal core of the tool.

FIG. 5 is an enlargement of the area included within circle 5 of FIG. 3 of the present invention showing the cutting surface of one of the polycrystalline diamond segments which is dispersed among the diamond particles.

DETAILED DESCRIPTION OF THE PREFERRED EMBODIMENT OF THE INVENTION

Figure 1:
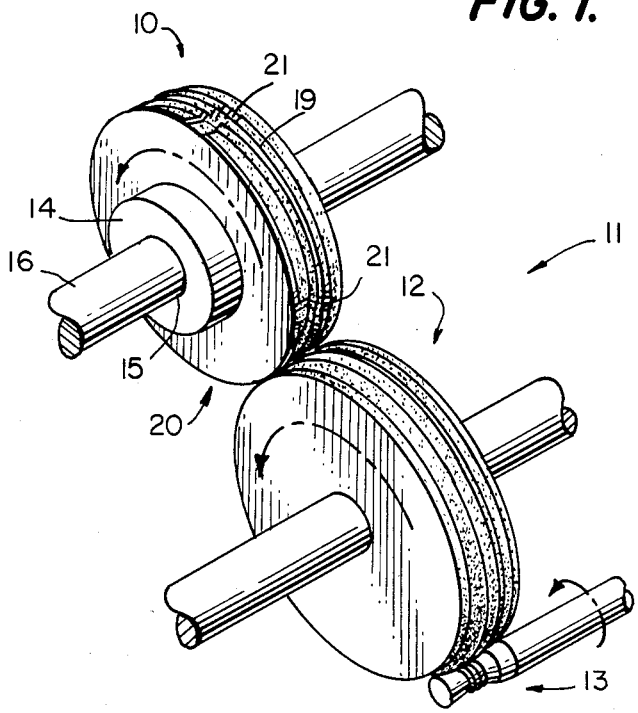
FIG. 1 is an elevational perspective view of the rotary dressing tool, constructed in accordance with the principles of the present invention, showing how the rotary dressing tool engages the abrasive wheel which in turn forms the part piece shown at the lower right of the figure.

The present invention provides a Rotary Dressing Tool of unusually long service life due to the co-utilization of natural or synthetic diamond particles and sintered superhard segments as cutting surfaces. Throughout the following detailed description of the present invention, like reference numerals are used to denote like parts disclosed in the accompanying drawings, FIGS. 1–5.

FIG. 1 shows the Rotary Dressing Tool, indicated generally at reference numeral 10, in its normal position as part of a dressing assembly, shown generally at reference numeral 11, where Rotary Dressing Tool 10 is in rotational contact with an abrasive wheel, shown generally ar reference numeral 12, which in turn is in rotational contact with the part piece of steel or other hard metal to be ground, shown generally at reference numeral 13. Rotary Dressing Tool 10 is generally rotated by a drive unit (not shown) at about 80 percent of the SFPM (surface feet per minute) of abrasive wheel 12. The exact adjustment of the RPM (revolutions per minute) of Rotary Dressing Tool 10, with respect to the RPM of abrasive wheel 12, depends upon the surface speed of abrasive wheel 10 and the relative diameters of Rotary Dressing Tool 10, abrasive wheel 12 and part piece 13.

Rotary dressing tool 10 has a cylindrical metal core 14, preferably of stainless steel, and a bore hole 15. Cylindrical metal core 14 serves as a framework for Rotary Dressing Tool 10 and permits Rotary Dressing Tool 10 to be readily mounted to driving spindle 16 of dressing assembly 11. A matrix 17 of abrasive resistant nickel based alloy, is bonded to cylindrical metal core 14 by a filler 18 of molten solder or plastic material.

As best shown in FIGS. 1 and 3, natural or synthetic diamonds particles 19 are dispersed about outer periphery 20 of Rotary Dressing Tool 10 and embedded in matrix 17 to provide a basic cutting surface for dressing abrasive wheel 12. In addition, three or more profiled segments 21, of sintered hard material, preferably polycrystalline synthetic diamonds, are interspersed in the natural or synthetic diamond particles 19 and matrix 17, as an integral part thereof, and spaced about outer periphery 20 of Rotary Dressing Tool 10 to provide an enhanced cutting surface not found in conventional diamond dressing wheels.

Figure 2:
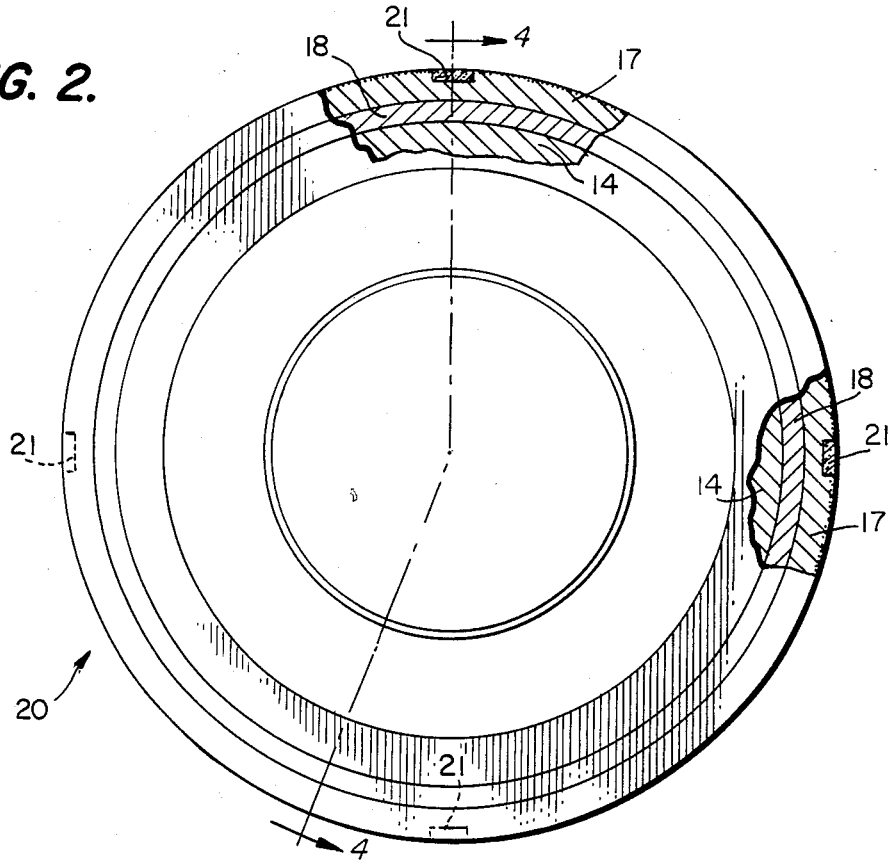
FIG. 2 is a side elevational view of the present invention showing how the diamond particles and the polycrystalline diamond segments are an integral part of the tool and are surrounded with a nickel based alloy.

As shown best in FIG. 2, for more uniform application of cutting force, profiled segments 21 are symmetrically spaced about outer periphery 20 of Rotary Dressing Tool 10. As best shown in FIGS. 2 and 4, matrix 17 completely surrounds profiled segments 21, making the segments, as well as natural or synthetic diamond particles 19, an integral unit for stability and wear. Tests by the inventor have revealed that polycrystalline synthetic diamonds are the most economical and efficient profiled segments 21 to use on Rotary Dressing Tool 10. As shown in FIG. 4, these polycrystalline synthetic diamond segments 21 are pre-profiled to the dimensional requirements of part piece 13, to be ground by abrasive wheel 12, prior to the installation of the profiled segments 21 in matrix 17. Pre-profiling segments 21 by a traveling wire e.d.m. was found to be most efficient where small radii and intricate profiles were involved. The darkened area of the blowup view of a polycrystalline synthetic diamond segment, shown in FIG. 5, indicates the cutting surface 22 of the profiled segment 21.

Figure 6:
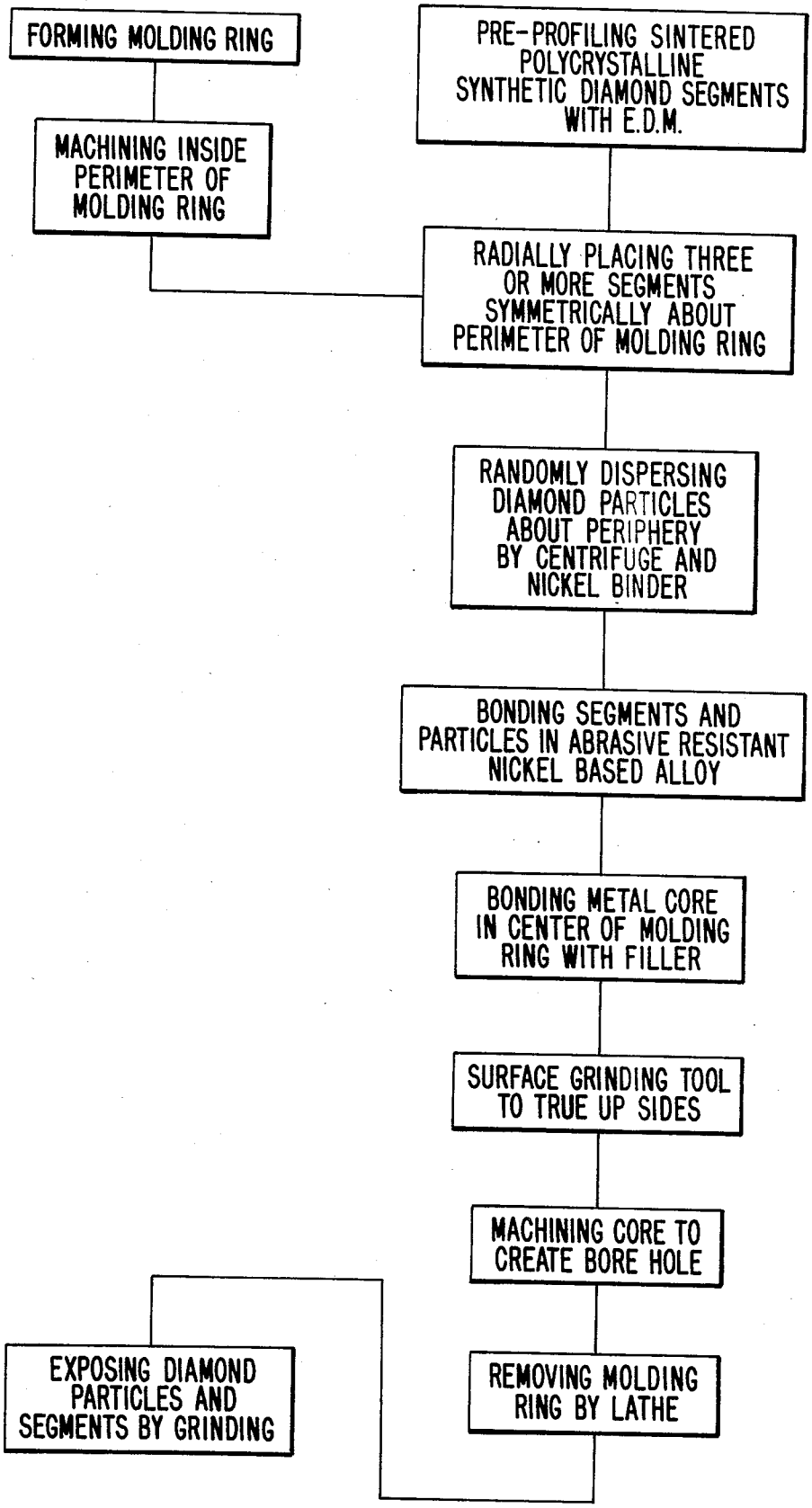
FIG. 6 illustrates the steps in the process of the present invention for constructing the preferred embodiment of the Rotary Dressing Tool.

As illustrated in FIG. 6, the method of the present invention, for constructing the preferred embodiment of the Rotary Dressing Tool 10 of the present invention, comprises the following the steps:

(1) forming three or more polycrystalline synthetic diamond segments 21 by pre-profiling cutting surface 22 of the segments to the dimensional requirements of the part piece 13 to be ground, using a traveling wire e.d.m., and (2) forming a molding ring of aluminum or high grade graphite, whose inside perimeter has been machined on a lathe to the negative profile of the part piece 13 to be ground by abrasive wheel 12, and (3) radially placing three or more polycrystalline synthetic diamond segments 21 symmetrically about the inner perimeter of the molding ring, in the formed area machined therein, holding the profiled segments 21 in place temporarily with an electrically conductive adhesive or a five minute epoxy, and (4) placing natural or synthetic diamond particles 19 in the molding ring, with an anode nickel cup in the center, and by means of a centrifuge randomly dispersing the diamond particles about the inside periphery of the molding ring where the diamond particles become attached by an electrically deposited nickel binder, and (5) placing the molding ring in a conventional nickel plating tank where the molding ring remains for an extended period of time, usually 16 days, under low direct current, preferably two amperes, to build a matrix 17 of abrasive resistant nickel based alloy approximately 0.200 in thickness, forming a permanent bond in and about the dispersed diamond particles 19 and the profiled segments 21, and (6) placing a cylindrical metal core 14, preferably of stainless steel, in the center of the molding ring and mechanically bonding cylindrical metal core 14 to matrix 17 by injecting a filler 18 of molten solder or plastic material into the space between the inside perimeter of the molding ring and the outer circumference of cylindrical metal core 14, and (7) surface grinding the tool to true up the sides of the tool so that the sides are perfectly parallel with respect to one another, and (8) machining cylindrical metal core 14 to create bore hole 15 which is concentric and square with respect to the diamond cutting surface of Rotary Dressing Tool 10, and (9) removing the molding ring from the exterior perimeter of Rotary Dressing Tool 10 by turning the molding ring in a lathe, and

(10) running the circumferential surface of Rotary Dressing Tool 10 into a grinding wheel to expose the diamond particles 19 and the polycrystalline synthetic diamond segments 21 down to their working surfaces.

Using the electrically deposited nickel method, Rotary Dressing Tool 10 of the present invention can be produced with extremely fine radii and intricate geometrics. Dimensional accuracies of plus or minus 0.0001 inch and radius sizes as small as 0.0023 inch are possible without lapping, as often required in tools of sintered powder. In order to produce the minute forms required of the nickel alloy tool 10, the size of diamond particles 19 selected must not exceed the overall size of the smallest geometry of the part piece 13 to be ground.

The conventional rotary diamond dressing tool operates upon rotational contact with an abrasive wheel. The diamond particles of the tool displace and shatter the abrasive grains on the abrasive wheel to reform and expose new cutting grains. The major wear of the diamond section occurs because the abrasive refuse rolls over the matrix, thus abrading the bonding surface of the diamond particles. The tool of the present invention operates somewhat in the same fashion as the conventional rotary diamond dressing wheel, however, the introduction of the polycrystalline synthetic diamond segments, or other superhard material, elevates the magnitude of abrasion which naturally occurs during dressing. As the profiled segments 21 of superhard material sweep over the abrasive surface of abrasive wheel 12, any buildup of abrasive refuse or part piece material is removed, minimizing abrasive wear on matrix 17. The profiled segments 21 also serve as an additional cutting edge. As the dispersed diamond particles 19 wear, the cutting action of the profiled segments 21 becomes more dominant, thus giving the tool of the present invention an additional enhanced service life not found in other rotary diamond dressing tools. The sweeping action of the profiled segments 21 also create a more open, free-cutting surface on the abrasive wheel 12, thus abrasive forces during operation of Rotary Dressing Tool 10 prove to be less.

I claim:

1. A rotary dressing tool to reform and recondition an abrasive wheel, comprising:

a cylindrical metal core, having a bore hole, which serves as a framework for said tool and permits said tool to be readily mounted to the driving spindle of a dressing assembly, and a matrix of abrasive resistant nickel based alloy bonded to said cylindrical metal core, and diamond particles dispersed about the outer periphery of said tool and embedded in said matrix to provide a basic cutting surface for dressing said abrasive wheel, and three or more profiled segments of sintered polycrystalline synthetic diamond material interspersed in said diamond particles and matrix as an integral part thereof and spaced about the outer periphery of said tool to provide an enhanced cutting surface for dressing said abrasive wheel.

2. The tool of claim 1, wherein said cylindrical metal core is of stainless steel.

3. The tool of claim 1, wherein said profiled segments are symmetrically spaced about the outer periphery of said tool.

4. The tool of claim 1, wherein said profiled segments are polycrystalline synthetic diamonds pre-profiled to the dimensional requirements of the part piece to be ground by said abrasive wheel.

5. The tool of claim 4, wherein said profiled segments are pre-profiled by a traveling wire e.d.m.

6. The method of constructing a rotary dressing tool comprising the steps:

forming three or more sintered polycrystalline synthetic diamond segments by pre-profiling the cutting surface of said segments to the dimensional requirements of the part piece to be ground, using a traveling wire e.d.m., and forming a molding ring of aluminum or high grade graphite, whose inside perimeter has been machined on a lathe to the negative profile of said part piece to be ground by said abrasive wheel, and radially placing said three or more sintered polycrystalline synthetic diamond segments symmetrically about the inner perimeter of said molding ring, in the formed area machined therein, holding said profiled segments in place temporarily with an electrically conductive adhesive or a five minute epoxy, and placing diamond particles in said molding ring, with an anode nickel cup in the center, and by means of a centrifuge randomly dispersing said diamond particles about the inside periphery of said molding ring where said diamond particles become attached by an electrically deposited nickel binder, and placing said molding ring in a conventional nickel plating tank where said molding ring remains for an extended period of time, under low direct current, to build a matrix of abrasive resistant nickel based alloy approximately 0.200 inches in thickness, forming a permanent bond in and about said dispersed diamond particles and said profiled segments, and placing a cylindrical metal core, preferably of stainless steel, in the center of said molding ring and mechanically bonding said cylindrical metal core to said matrix by injecting a filler of molten solder or plastic material into the space between the inside perimeter of said molding ring and the outer circumference of said cylindrical metal core, and surface grinding said tool to true up the sides of said tool so that said sides are perfectly parallel with respect to each other, and machining said cylindrical metal core to create a bore hole which is concentric and square with respect to the diamond cutting surface of said rotary dressing tool, and removing said molding ring from the exterior perimeter of said rotary dressing tool by turning said molding ring in a lathe, and running the circumferential surface of said rotary dressing tool into a grinding wheel to expose said diamond particles and said sintered polycrystalline synthetic diamond segments down to their working surfaces.

* * * * *